United States Patent [19]

Tamura et al.

[11] Patent Number: 4,477,786

[45] Date of Patent: Oct. 16, 1984

[54] SEMI-COAXIAL CAVITY RESONATOR FILTER

[75] Inventors: Masahide Tamura; Koga Daisuke, both of Samukawa, Japan

[73] Assignee: Toyo Communication Equipment Co., Ltd., Kouza, Japan

[21] Appl. No.: 432,930

[22] PCT Filed: Jan. 26, 1982

[86] PCT No.: PCT/JP82/00026

§ 371 Date: Sep. 27, 1982

§ 102(e) Date: Sep. 27, 1982

[87] PCT Pub. No.: WO82/02626

PCT Pub. Date: Aug. 5, 1982

[30] Foreign Application Priority Data

Jan. 26, 1981 [JP] Japan ..... 56-10563

[51] Int. Cl.[3] ..... H01P 1/205; H01P 7/04

[52] U.S. Cl. ..... 333/207; 333/206; 333/224; 333/235

[58] Field of Search ..... 333/202–212, 333/219–235, 245, 248; 334/41–45; 330/56; 331/101

[56] References Cited

U.S. PATENT DOCUMENTS 3,273,083 9/1966 Rose ..... 333/202 X 4,268,809 5/1981 Makimoto et al. ..... 333/202

*Primary Examiner*—Marvin L. Nussbaum

*Attorney, Agent, or Firm*—Cushman, Darby & Cushman

[57] ABSTRACT

A semi-coaxial cavity resonator filter including a plurality of semi-axial cavity resonators, as constructed units, each of which has an adjustable device in which dielectric substrates having a specific dielectric constant of more than 1 are disposed in the gap between the inside wall of a tube-shaped outer conductor and the open end of an inner conductor provided on the inside wall of the outer conductor, and the electrostatic capacitance of the spaces interposed by the dielectric substrates is changed without steps by varying the area of the electrodes on the dielectric substrate. The filter is made by making an individual and predetermined frequency adjustment on the plurality of the semi-axial cavity resonators and then cascade-connecting those resonators in one block through shielding plates having a coupling iris so as to obtain desired filtering characteristics as a bandpass filter.

6 Claims, 10 Drawing Figures

SEMI-COAXIAL CAVITY RESONATOR FILTER

DESCRIPTION

Technical Field

This invention relates to a band pass filter in which semi-coaxial cavity resonators are connected in multiple stages.

Background Art

A band pass filter in which semi-coaxial cavity resonators are connected in multiple stages is heretofore widely used to obtain sufficient selective characteristic and low loss property as a filter to be used in the VHF or UHF band. However, such a conventional filter requires very complicated adjustments to obtain desired band pass filter characteristic due to the fact that the resonance frequency and the characteristic impedance of the semi-coaxial cavity resonators in each stage affect adversely each other when connected in cascade. Further, it is necessary to maintain high dimensional accuracy of the respective portions of the filter, causing expensive production cost.

The inventors of the present invention have previously proposed, as disclosed in Japanese patent application No. 53-72569 (Japanese patent Laid-Open No. 54-163656), an inexpensive and readily adjustable band pass filter in which a rectangular cylinder made by cutting across a rectangular waveguide available in the market is used as an outer conductor (outer housing) of each stage, both opening ends of the cylinder are blocked with flat plates and an inner conductor is disposed in the outer conductor. Thus, the semi-coaxial cavity resonators of the respective stages are individually manufactured, are then adjusted in a predetermined resonance frequency, and are coupled integrally, thereby reducing the material cost and the number of adjusting steps.

The present invention principally follows the above-mentioned construction type, and this construction will be described in more detail in the later description of the embodiments of the present invention.

There has been a need for smaller mobile radio communication equipment such as automotive radio telephones and portable radio equipment, in which smaller components such as smaller filters must be employed. In order to meet this need, a filter such as disclosed in the Japanese patent application No. 52-15204 (Japanese patent Laid-Open No. 53-999849) has been proposed, in which a multiple of resonators are so constructed that a dielectric material 2 is filled in the space inside an outer conductor 1 of a semi-coaxial cavity resonator so as to surround an inner conductor 3 and is maintained in electric contact with the outer conductor 1 through an electrode 4 as shown in FIGS. 1 and 2 and the degree of coupling between the resonators is adjusted by a coupling adjustment screw 5. The resonators are connected in multiple stages. According to this conventional filter, the space between the inner conductors 3 and 3 can be reduced as compared with the case of an air-filled filter of the same band width, and the resonance frequency can be stabilized by compensating the influence of the thermal expansion of the outer and inner conductors 1 and 3 through properly chosing the temperature coefficient of the dielectric material 2.

However, a filter having such construction has obviously the following drawbacks and disadvantages.

When titanium oxide series ceramics having a good temperature characteristic is used as a dielectric material, the filter of the above-mentioned construction becomes very expensive in view of unit cost and amount used, and also becomes heavy.

Further, although the Japanese patent application does not disclose the frequency adjustment method of the respective resonators forming the filter, this adjustment cannot be considered easy. The adjustment of the filtering characteristic with a coupling adjustment screw 5 requires considerable skill.

Disclosure of Invention

This invention contemplates to eliminate the above-mentioned drawbacks and disadvantages of the conventional band pass filter and provides a band pass filter in which a semi-coaxial cavity resonator comprises a cylindrical conductor having a suitable section used as an outer conductor, an adequate dielectric substrate disposed in an air gap between an open end of an inner conductor provided in the outer conductor and an inner wall of the outer conductor, and electrostatic capacity controlling means for steplessly varying the area of the electrode of the dielectric substrate. The semi-coaxial cavity resonator is used as a unit constituent of the filter, and each unit, after received a predetermined frequency adjustment, is integrally coupled with each other, thereby remarkably reducing the number of assembling steps, its volume and weight as well as it cost.

In the conventional semi-coaxial cavity resonator using no dielectric substrate, the air gap between the open end of the inner conductor and the outer conductor is reduced as small as possible to increase the electrostatic capacity therebetween and the reduction ratio of the resonator, thereby reducing the size of the resonator. However, since the highest voltage is applied to the air gap at the time of electric resonance in such semi-coaxial cavity resonator, it is not preferable from the view point of passing electric power resistant characteristic of the resonator to extremely reduce the air gap. Further, it is difficult to provide an extremely reduced air gap in manufacturing the filter without irregularity, causing the manufacturing cost to increase. According to the present invention, by filling the air gap with a dielectric substrate having a specific dielectric constant larger than the air, the electrostatic capacity between the open end of the inner conductor and the outer conductor can be sufficiently increased without deteriorating the passing electric power resistant characteristic, and accordingly the reduction rate of the resonator dimensions can be improved and hence the filter can be largely reduced in size. For example, in the filter designed by the inventors of the present invention, reduction of at least one-quarter can be obtained with titanium oxide series ceramics being used as the dielectric material while a predetermined specification is satisfied. Therefore, the volume of the filter can be reduced to substantially approximately a quarter. In addition, since the thickness of the dielectric substrate can be precisely controlled by a proper machining such as polishing, the adjustment of the electrostatic capacity can be accurately performed, and a resonator having desired characteristics with minimum characteristic variation can be inexpensively obtained.

The conventional semi-coaxial cavity resonator tends to vary the resonance frequency due to temperature change causing dimensional variations of the outer and inner conductors, and accordingly must employ expensive material having a small thermal expansion coefficient, e.g., Invar or the like when high performance is required.

On the other hand, according to the present invention using a dielectric substrate, by employing a substrate material such as titanium oxide series ceramic substrate, in which the rate of change of its dielectric constant due to the temperature can be arbitrarily selected, the variations in the resonance frequency due to the thermal deformations of the inner and outer conductors can be compensated and offset by the variation in the dielectric substrate. Accordingly, inexpensive material, e.g., brass, aluminum, etc. can be used for the inner and outer conductors.

By using the dielectric substrate, the present invention further provides an increase in the insulating withstand voltage of the filter. For instance, when alumina is used for the dielectric substrate, its insulating withstand voltage is 10 to 16 kV/mm, becoming approx. 5 times that of air whose insulating withstand voltage is 3 kV/mm, and it is very advantageous from the viewpoint of the passing electric power resistance.

The features and advantages of the present invention will now be listed below.

(1) Since a dielectric material having a specific dielectric constant higher than that of air is disposed in the air gap between the open end of the inner conductor and the outer conductor, thereby increasing the reduction rate of the resonator, the overall filter can be remarkably reduced in size and weight. As a result that the filter is designed with titanium oxide series ceramics when predetermined specifications of the filter are satisfied, the volume of the filter can be reduced to ¼ of the conventional filter.

(2) By selecting suitably the material of the dielectric material the variation in the resonance frequency due to the thermal deformation of the resonator can be compensated, whereby the resonator can be formed of an inexpensive material having a relatively large thermal expansion coefficient, effecting remarkably reduction in its cost.

(3) Since a dielectric material having large insulating withstand voltage can be selected, the filter is advantageous when used for a signal of large electric power in view of high passing power resistance.

(4) Since the thickness of the dielectric substrate can be precisely controlled readily, controlling of the electrostatic capacity thereof can be performed, thereby easily obtaining desired filter characteristics.

(5) Since each resonator used as the unit constituent of the filter is individually adjusted in frequency and is integrally assembled with each other, the frequency adjustment of the filter after the assembly can be simplified, reducing the number of assembling steps and hence the cost.

Best Mode of Carrying Out the Invention

The present invention will now be described in more detail with reference to the accompanying drawings regarding the embodiments.

Figure 1:
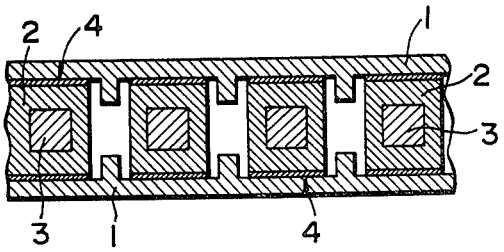
FIG.1 PRIOR ART
FIGS. 1 and 2 are sectional views showing one example of the conventional art using a dielectric material in the semi-coaxial cavity resonator filter.
Figure 2:
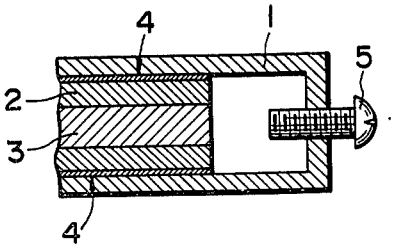
FIG.2 PRIOR ART
Figure 3:
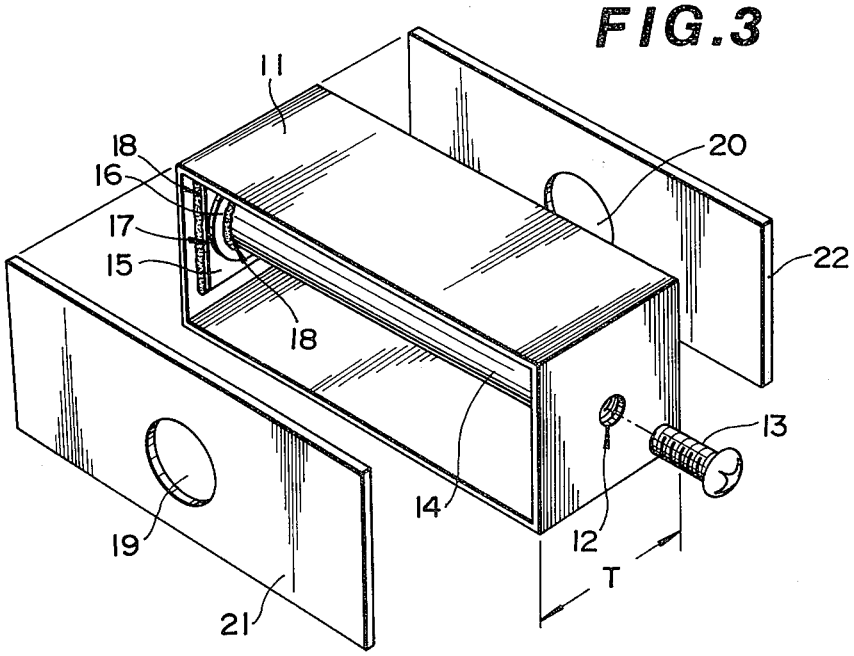
FIG. 3 is an exploded perspective view of the semi-coaxial cavity resonator as the unit constituent of the filter according to the present invention.
Figure 4:
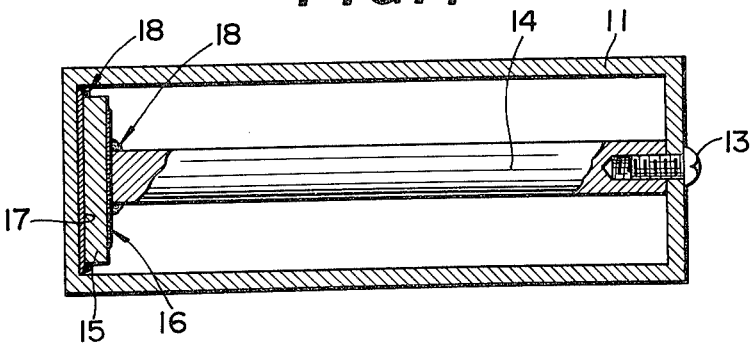
FIG. 4 is a sectional view of the assembly of the filter.

FIGS. 3 and 4 are exploded perspective and sectional views of the semi-coaxial cavity resonator used as a unit constituent of the band pass filter according to the present invention.

In the drawings, an outer conductor 11 is used as a resonator housing by cutting in a predetermined length T a rectangular waveguide (specified in dimensional accuracy by Japanese Industrial Standard) available in the market across the waveguide. In an ordinary filter construction, a plurality of the resonators having the same size T are connected in multiple stages.

A hole 12 is formed at the front side wall of the outer conductor 11, an inner conductor 14 is secured internally to the outer conductor 11 through the hole 12 with a screw 13, and the screw 13 is used as a ground terminal. A dielectric substrate 15 is inserted into an air gap between the rear side wall of the outer conductor 11 and the other end (open end) of the inner conductor 14, and electrodes 16, 17 are provided on opposite surfaces of the substrate 15. These electrodes 16, 17 are electrically connected by solder or with conductive adhesive 18 or the like both to the open end of the inner conductor 14 and to the rear side wall of the outer conductor 11. Further, shielding plates 21, 22 provided with coupling windows 19, 20 are contacted with both open ends of the outer conductor 11, and one stage of the semi-coaxial cavity resonator is thus constructed.

Figure 5:
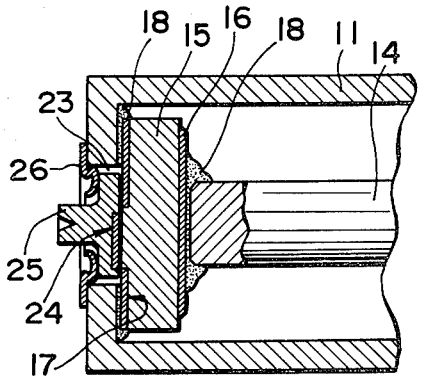
Figs. 5, 6*a* and 6*b* are views for explaining one preferred embodiment of the electrostatic capacity adjusting means provided in the semi-coaxial cavity resonator of the present invention.
Figure 6A:
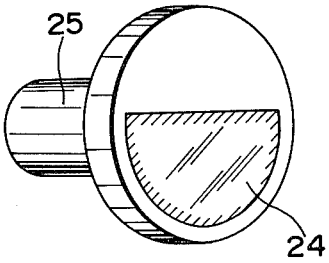
Figure 6B:
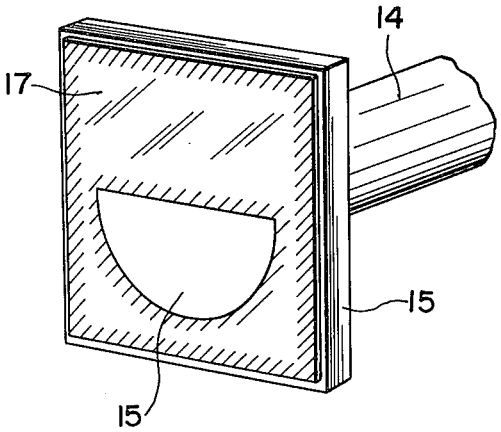

The adjustment of the resonance frequency of the semi-coaxial cavity resonator thus constructed is carried out by a mechanism shown in FIGS. 5, 6*a*, 6*b*.

More particularly, a circular hole 23 having an adequate area is opened at the rear side wall of the outer conductor 11 bonded with the electrode 17 of the dielectric substrate 15, and a capacity adjustment knob 25 made of an insulating material having a semicircular pattern electrode 24 shown in FIG. 6*a* is rotatably placed in the circular hole 23 by means of a suitable spring member 26 so that the surface of the semicircular electrode 24 is contacted under pressure with the surface of the electrode 17 of the dielectric substrate 15.

The electrode 17 is exfoliated semicircularly, as shown in FIG. 6*b* to expose the dielectric material 15 on the surface of the electrode 17 in a manner to confront the semicircular electrode 24 of the capacity adjustment knob 25.

Since the area of the electrode 17 of the dielectric substrate 15 can be steplessly varied by rotating the capacity adjustment knob 25 according to the above-mentioned adjustment device, the electrostatic capacity and hence the resonance frequency of the resonator can be finely adjusted.

Figure 7:
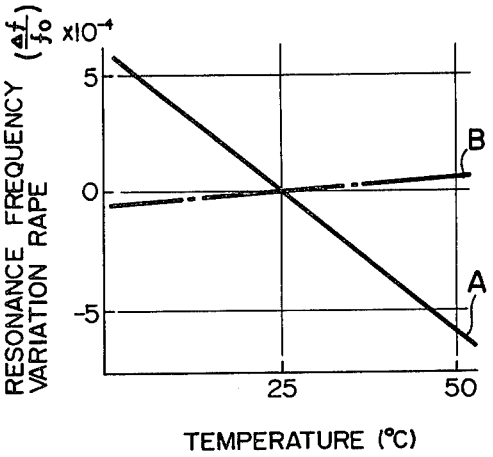
FIG. 7 is a graph showing the relationship between the temperature and the rate of change in the resonance frequency of the embodiment of the invention.

Referring to FIG. 7, a solid line A shows the temperature vs. resonance frequency change rate characteristic ($\Delta f/f_0$) of the conventional semi-coaxial cavity resonator using no dielectric substrate, and a broken line B shows the change rate characteristic in case that the titanium oxide series ceramic substrate having $-23\times10^{-6}$/°C. of the change rate of the dielectric constant by temperature is inserted into the air gap. In FIG. 7, the characteristic curve A exhibits large temperature vs. resonance frequency change rate of the resonator as approx. $6\times10^{-4}$/0° to 50° C. because aluminium (having $23\times10^{-6}$/°C. of linear expansion coefficent) is used as the material of the outer and inner conductors. On the other hand, the characteristic curve B exhibits reduced temperature-resonance frequency change rate of approx. $1\times10^{-4}$/0° to 50° C. This temperature characteristic is equal to that of the conventional semi-coaxial cavity resonator using Invar. For providing the electrodes 16, 17 at both sides of the dielectric substrate 15 as shown in FIG. 3, thin metallic deposition or thick film printing on the dielectric sustrate 15 is effective and therefore exclusively used. In this case, an appropriate electrode material must be selected so as not to cause exfoliation of the electrodes 16, 17 due to the stress produced by the unbalance of the thermal expansion coefficients in the outer and the inner conductors 11, 14 and the dielectric substrate 15.

As to a dielectric substrate material, besides the titanium oxide series ceramics or alumina, any material having small dielectric loss may be used, and when the quality factor of the resonator is desired to be increased, Teflon, mica, glass, etc. may be employed.

Now, the method of constructing the band pass filters composed by cascade-connecting a plurality of semi-coaxial cavity resonators will be described.

Figure 8:
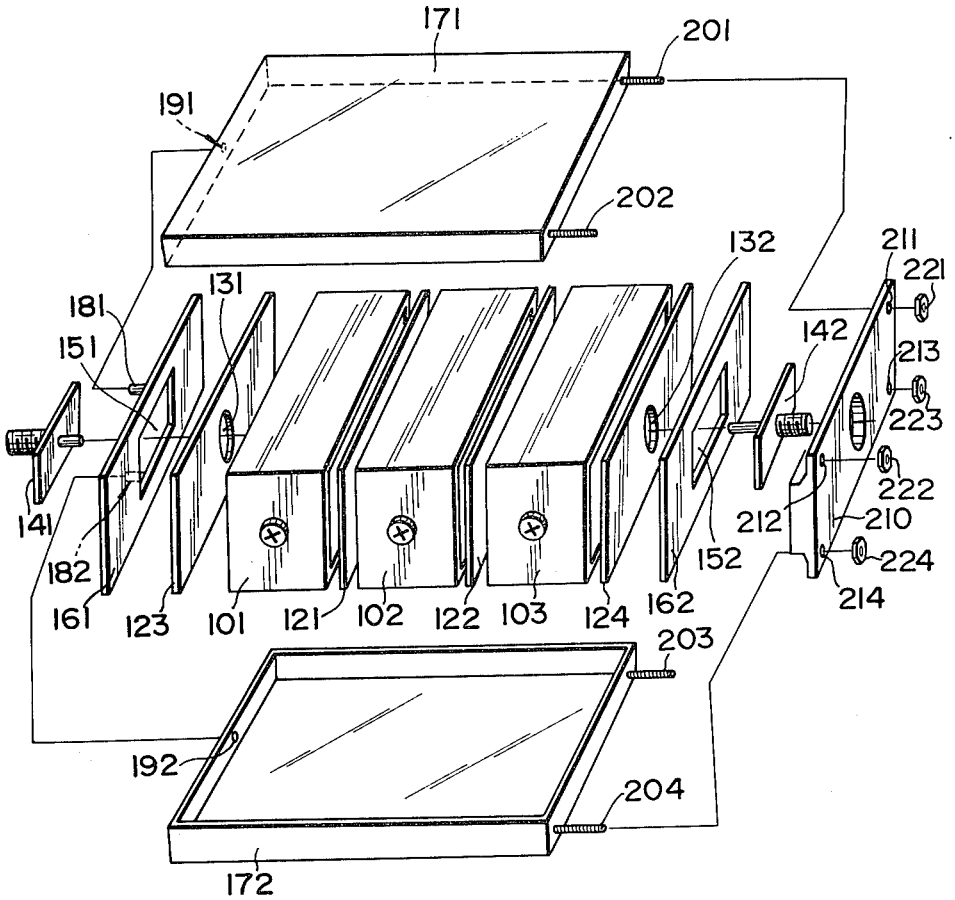
FIGS. 8 and 9 are exploded perspective and assembling sectional views showing one embodiment of the assembling sequence of the semi-coaxial cavity resonator filter of the invention.

In FIG. 8, outer conductors 101, 102 and shielding plates 121, 122 for shielding between the connectors have coupling windows 111, 112 (FIG. 9), and shielding plates 123, 124 for shielding the input and output side openings of the outer conductors 101, 103 respectively have input and output terminal plug mounting holes 131, 132, and these components are arranged as shown therein.

Further, clamping plates 161, 162 formed with escape holes 151, 152 for the plugs 141, 142 of the input and output terminals are disposed outwardly of the shielding plates 123, 124, and are contained in a set of upper and lower assembling frames 171, 172. The frames 171, 172 are formed with a shallow cover in tray shape, and have holes 191, 192 engaged with positioning pins 181, 182 on the clamping plates 161, 162 provided at the edge of the input terminal side.

Figure 9:
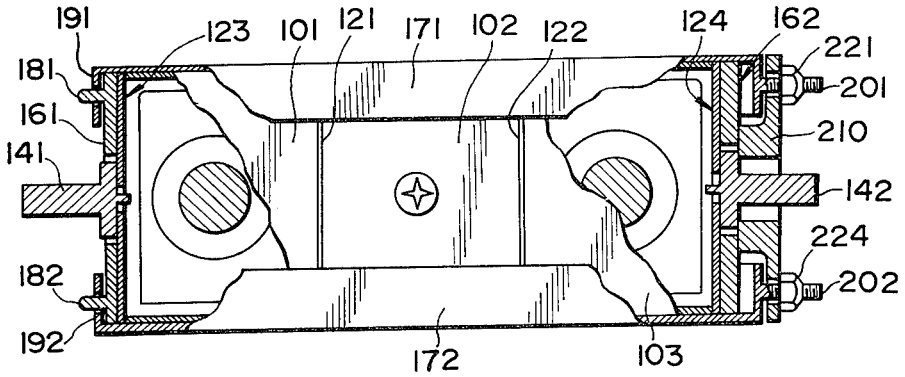

Further, clamping bolts 201, 202 and 203, 204 to be engaged with the holes 211, 212 and 213, 214 formed at four corners of a filter assembly clamping plate 210 for integrally clamping the filter assemblies mounted at the edge of the output terminal side are provided at the edge of filter assembly clamping plate 210. After all these components are assembled, the bolts are clamped with nuts 221, 222, 223, 224 via the filter assembly clamping plate 210, and the filter assembly shown in cross section in FIG. 9 is thus formed.

In the embodiment described above, three resonators are connected, but any number of resonators may be connected as required within the spirit and scope of the present invention, and the length of the assembly frames 171, 172 may be altered in such cases. The sectional shape of the outer conductor may not always be limited to the rectangular shape, but may be circular, or other different shape.

The resonance frequencies of the respective stages of the resonators are adjusted before being assembled. In assembling, the shielding plates having the input and output plugs are respectively mounted on the outer conductors 101, 102 and 103 as jigs, and the aforementioned capacity adjustment knobs 25 may be rotated individually to fine adjust the resonance frequency.

The frequency adjustment may also be performed by removing the capacity adjustment knob 25 having the electrode 24 and the spring member 26 from the hole 23 opened at the rear side wall of the outer conductor, attaching the electrode to the overall surface of the dielectric substrate 15 and gradually cutting the exposed part at the hole 23 of the electrode.

Industrial Applicability

Since the present invention has the foregoing advantages, it is particularly adapted for a band pass filter used for such equipment as an automotive radio telephone required for high stability with reduced size and weight, providing large industrial values.

We claim:

1. A semi-coaxial cavity resonator filter comprising:

a plurality of semi-coaxial cavity resonators each having an outer conductor formed in the shape of a tube of a predetermined length, an inner conductor provided in said outer conductor, one end of said inner conductor being secured to an inner wall of said outer conductor, a dielectric substrate having a specific dielectric constant larger than 1 disposed in a gap formed between the other end of said inner conductor and the adjacent inner wall of said outer conductor, each side of said dielectric substrate having an electrode in contact therewith, electrostatic capacity adjusting means for adjusting the electrostatic capacity between said electrodes, and a shielding plate having a coupling window therein, said resonators being integrally connected in cascade via said shielding plate.

2. A semi-coaxial cavity resonator filter as claimed in claim 1 wherein said dielectric substrate is a titanium oxide series ceramic substrate.

3. A semi-coaxial cavity resonator filter as claimed in claim 1 wherein said dielectric substrate is an alumina substrate.

4. A semi-coaxial cavity resonator filter as claimed in claim 1 wherein said dielectric substrate is a macromolecular compound resin substrate.

5. A semi-coaxial cavity resonator filter as claimed in claim 1 wherein said electrostatic capacity adjusting means performs electrostatic capacity adjusting by steplessly varying the area of said electrodes contacted with said dielectric substrate.

6. A semi-coaxial cavity resonator filter as claimed in claim 1 wherein each of said resonators is integrally connected to each other by way of a respective shielding plate having a coupling window after resonance frequency thereof has been adjusted by said electrostatic capacity adjusting means.

* * * * *